US007253783B2

(12) United States Patent
Chiang et al.

(10) Patent No.: US 7,253,783 B2
(45) **Date of Patent: *Aug. 7, 2007**

(54) LOW COST MULTIPLE PATTERN ANTENNA FOR USE WITH MULTIPLE RECEIVER SYSTEMS

(75) Inventors: Bing Chiang, Melbourne, FL (US); Kenneth M. Gainey, Satellite Beach, FL (US); James A. Proctor, Jr., Melbourne Beach, FL (US); Antoine J. Rouphael, Escondido, CA (US); Griffin K. Gothard, Satellite Beach, FL (US); Michael J. Lynch, Merritt Island, FL (US)

(73) Assignee: IPR Licensing, Inc., Wilmington, DE (US)

( * ) Notice: Subject to any disclaimer, the term of this patent is extended or adjusted under 35 U.S.C. 154(b) by 72 days.

This patent is subject to a terminal disclaimer.

(21) Appl. No.: 11/101,914

(22) Filed: Apr. 8, 2005
(Under 37 CFR 1.47)

(65) Prior Publication Data

US 2005/0174298 A1 Aug. 11, 2005

Related U.S. Application Data

(63) Continuation of application No. 10/664,413, filed on Sep. 17, 2003, now Pat. No. 6,894,653.

(60) Provisional application No. 60/411,570, filed on Sep. 17, 2002.

(51) Int. Cl.
*H01Q 3/00* (2006.01)

(52) U.S. Cl. ..... 343/757; 343/853; 343/749

(58) Field of Classification Search ..... 343/853, 343/833, 834, 757, 749; 342/359, 372
See application file for complete search history.

(56) References Cited

U.S. PATENT DOCUMENTS 4,169,266 A 9/1979 Bachvarov (Continued)

FOREIGN PATENT DOCUMENTS

DE 27 29 395 A1 1/1979

(Continued)

OTHER PUBLICATIONS

Lo, Y.T., & Lee, S.W., editors, *Antenna Handbook, Theory, Applications and Design*, pp. 3-21-3-43, Van Nostrand Reinhold Co., New York 1988.

*Primary Examiner*—Hoang V. Nguyen
(74) *Attorney, Agent, or Firm*—Volpe and Koenig, P.C.

(57) ABSTRACT

An antenna assembly includes at least two active or main radiating omni-directional antenna elements arranged with at least one beam control or passive antenna element used as a reflector. The beam control antenna element(s) may have multiple reactance elements that can electrically terminate it to adjust the input or output beam pattern(s) produced by the combination of the active antenna elements and the beam control antenna element(s). More specifically, the beam control antenna element(s) may be coupled to different terminating reactances to change beam characteristics, such as the directivity and angular beamwidth. Processing may be employed to select which terminating reactance to use. Consequently, the radiator pattern of the antenna can be more easily directed towards a specific target receiver/transmitter, reduce signal-to-noise interference levels, and/or increase gain. A Multiple-Input, Multiple-Output (MIMO) processing technique may be employed to operate the antenna assembly with simultaneous beam patterns.

21 Claims, 17 Drawing Sheets

U.S. PATENT DOCUMENTS

| | | | |
|---|---|---|---|
| 5,243,358 | A | 9/1993 | Sanford et al. |
| 5,257,031 | A | 10/1993 | Scarpetta et al. |
| 5,485,167 | A | 1/1996 | Wong et al. |
| 5,767,807 | A | 6/1998 | Pritchett |
| 6,310,585 | B1 | 10/2001 | Marino |
| 6,369,770 | B1 | 4/2002 | Gothard et al. |
| 6,397,082 | B1 | 5/2002 | Searle |
| 6,515,635 | B2 | 2/2003 | Chiang et al. |
| 6,600,456 | B2 | 7/2003 | Gothard et al. |
| 6,788,268 | B2 | 9/2004 | Chiang et al. |
| 2003/0030594 | A1 | 2/2003 | Larry |
| 2003/0048226 | A1 | 3/2003 | Gothard et al. |

FOREIGN PATENT DOCUMENTS

| | | | |
|---|---|---|---|
| EP | 0 523 409 | A1 | 6/1992 |
| WO | WO 01/56189 | A1 | 8/2001 |

4.2753e+000

4.0633e+000

3.8470e+000

LOW COST MULTIPLE PATTERN ANTENNA FOR USE WITH MULTIPLE RECEIVER SYSTEMS

RELATED APPLICATIONS

This application is a continuation of U.S. application Ser. No. 10/664,413, filed Sep. 17, 2003, now U.S. Pat. No. 6,894,653, which claims the benefit of U.S. Provisional Application No. 60/411,570, filed on Sep. 17, 2002. The entire teachings of the above applications are incorporated herein by reference.

BACKGROUND OF THE INVENTION

It is becoming increasingly important to reduce the size of radio equipment to enhance its portability. For example, the smallest available cellular telephone handset today can conveniently fit into a shirt pocket or small purse. In fact, so much emphasis has been placed on obtaining small size for radio equipment that corresponding antenna gains are extremely poor. For example, antenna gains of the smallest handheld phones are only −3 dBi or even lower. Consequently, the receivers in such phones generally do not have the ability to mitigate interference or reduce fading.

Some prior art systems provide multiple element beam formers for these purposes. These antenna systems are characterized by having at least two radiating elements and at least two receivers that use complex magnitude and phase weighting filters. These functions can be implemented either by discrete analog components or by digital signal processors. The problem with this type of antenna system is that performance is heavily influenced by the spatial separation between the antenna elements. If the antennas are too close together or if they are arranged in a sub-optimum geometry with respect to one another, then the performance of the beam forming operation is severely limited. This is indeed the case in many compact wireless electronic devices, such as cellular handsets, wireless access points, and the like, where it is very difficult to obtain sufficient spacing or proper geometry between antenna elements to achieve improvement.

Indoor multipaths, mostly outside the main beam, interfere with the main beam signal and create fading. The indoor multi paths also create standing wave nulls that prevent reception if the directive antenna is situated at these nulls. For a traditional array, if one element of the array is at the null, the received signal is still significantly reduced. Reciprocity makes this effect hold true for the transmit direction, too.

SUMMARY OF THE INVENTION

This invention relates to an adaptive antenna array for a wireless communications application that optionally uses multiple receivers. The invention provides a low cost, compact antenna system that offers high performance with the added advantage of providing multiple isolated spatial antenna beams or effecting an aggregate antenna beam. It can be used for multiple simultaneous receive and transmit functions, suitable for Multiple-Input, Multiple Output (MIMO) applications.

Devices that can benefit from the technology underlying the invention include, but are not limited to, cellular telephone handsets such as those used in Code Division Multiple Access (CDMA) systems such as IS-95, IS-2000, CDMA 2000 and the like, Time Division Multiple Access (TDMA) systems, Frequency Division Multiple Access (FDMA) systems, wireless local area networking equipment such as IEEE 802.11 or WiFi access equipment, and/or military communications equipment such as ManPacks, and the like.

In one embodiment, an antenna assembly includes at least two active or main radiating antenna elements arranged with at least one beam control or passive antenna element electromagnetically disposed between them. The beam control antenna element(s), referred to herein as beam control or passive antenna element(s), is/are not used as active antenna element(s). Rather, the beam control antenna element(s) is/are used as a reflector by terminating its/their signal terminal(s) into fixed or variable reactance(s). As a result, a system using the antenna assembly can adjust the input or output beam pattern produced by the combination of at least one main radiating antenna elements and the beam control antenna element(s). More specifically, the beam control antenna element(s) may be connected to different terminating reactances, optionally through a switch, to change beam characteristics, such as the directivity and angular beamwidth, or the beam control antenna element(s) may be directly attached to ground. Processing may be employed to select which terminating reactance to use.

Consequently, the radiator pattern of the antenna can be more easily directed towards a specific target receiver/transmitter, reduce signal-to-noise interference levels, and/or increase gain. The radiation pattern may also be used to reduce multipath effects, including indoor multipath effects. One result is that cellular fading can be minimized.

In one embodiment, at least one beam control antenna element is positioned to lie along a common line with the two active antenna elements, referred to as a one-dimensional array or curvi-linear array. However, the degree to which the active and beam control antenna elements lie along the same line can vary, depending upon the specific needs of the application. In another embodiment, more than two active antenna elements are arranged in a predetermined shape, such as a circle, with at least one beam control antenna element electromagnetically coupled to the active antenna elements. Shapes beyond the one-dimensional array or curvi-linear array are generally referred to as a two-dimensional array.

The spacing of the active antenna elements with respect to the beam control antenna elements can also vary upon the application. For example, the beam control antenna element can be positioned about one-quarter wavelength from each of the two active antenna elements to enhance beam steering capabilities. This may translate to a spacing to between approximately 0.5 and 1.5 inches for use in certain compact portable devices, such as cellular telephone handsets. Such an antenna system will work as expected, even though such a spacing might be smaller than one-quarter of a corresponding radio wavelength at which the antennas are expected to operate.

The invention has many advantages over the prior art. For example, the combination of active antenna elements with the beam control antenna element(s) can be employed to adjust the beam width of an input/output beam pattern. Using few components, an antenna system using the principles of the present invention can be easily assembled into a compact device, such as in a portable cellular telephone or Personal Digital Assistant (PDA). Consequently, this steerable antenna system can be inexpensive to manufacture.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
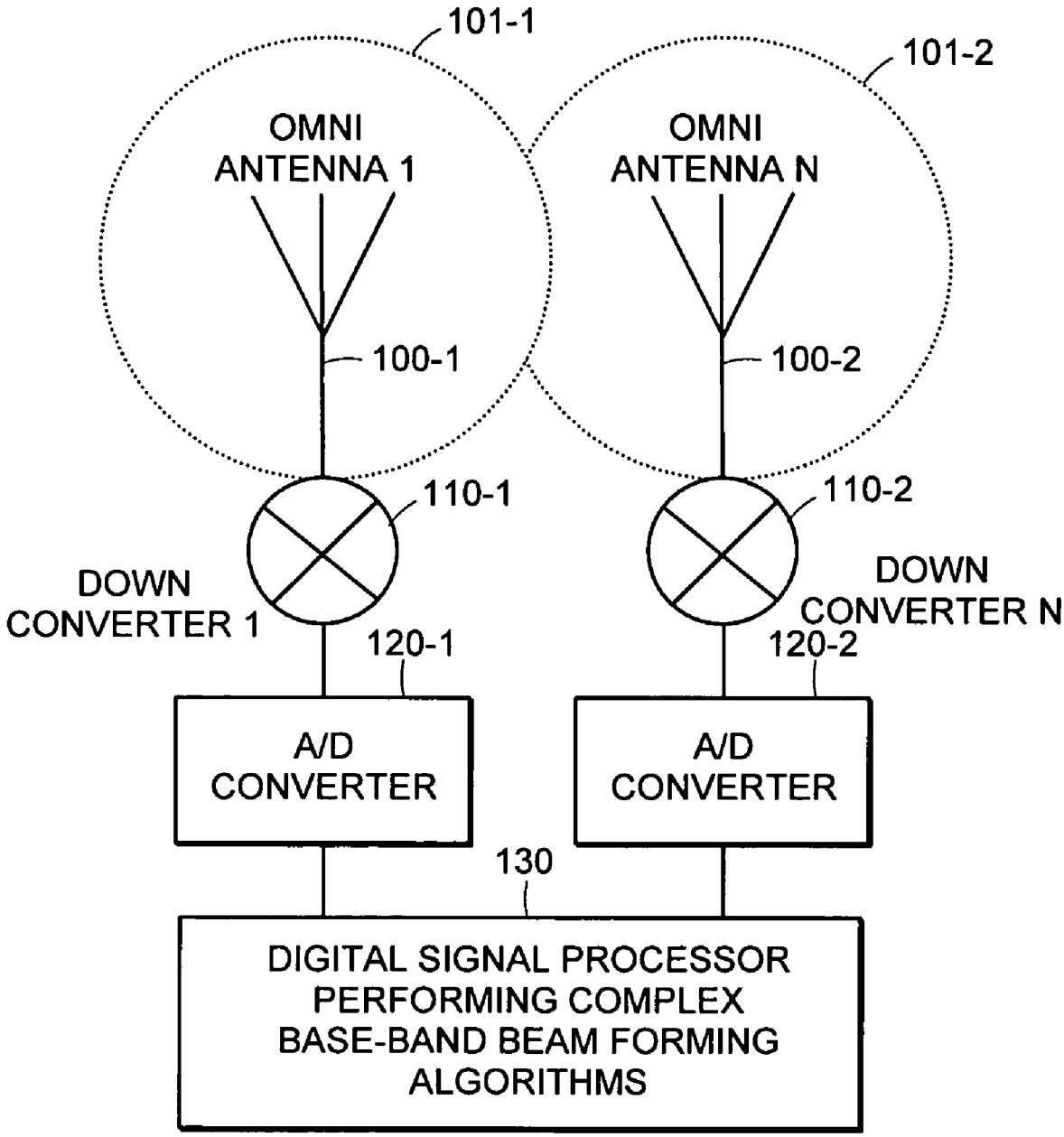
PRIOR ART FIG. 1
FIG. 1 is a schematic diagram of a prior art beam former antenna system with two active antenna elements.

FIG. 1 illustrates prior art multiple element beam former. Such systems are characterized by having at least two active or radiating antenna elements 100-1, 100-2 that have associated omni-directional radiating patterns 101-1, 101-2, respectively. The antenna elements 100 are each connected to a corresponding radio receiver, such as down-converters 110-1 and 110-2, which provide baseband signals to a respective pair of Analog-to-Digital (A/D) converters 120-1, 120-2. The digital received signals are fed to a digital signal processor 130. The digital signal processor 130 then performs baseband beam forming algorithms, such as combining the signals received from the antenna elements 100 with complex magnitude and phase weighting functions.

One difficulty with this type of system is that performance is heavily influenced by the spatial separation and geometry of the antenna elements 100. For example, if the antenna elements 100 are spaced too close together, then performance of the beam forming operation is reduced. Furthermore, the antenna elements 100 themselves must typically have a geometry that is of an appropriate type to provide not only the desired omni-directional pattern but also operate within the geometry for the desired wavelengths. Thus, this architecture is generally not of desirable use in compact, hand held wireless electronic devices, such as cellular telephones and/or low cost wireless access points or stations (sometimes referred to as a client device or station device), where it is difficult to obtain sufficient spacing between the elements 100 or to manufacture antenna geometries at low cost.

In contrast to this, one aspect of the present invention is to form directional multiple fixed antenna beams, such as a semi-omni or so called "peanut" pattern in a very small space. Specifically, referring to FIG. 2, there is the same pair of active antenna elements 100-1, 100-2 as in the prior art of FIG. 1; however, according to the principles of the present invention, a passive or beam control antenna element 115 is inserted between the active antenna elements 100. In a receive mode, received signals are fed to the corresponding pair of down converters 110-1, 110-2, A/D converters 120-1, 120-2, and Digital Signal Processor (DSP) 130, as in the prior art.

With this arrangement, two beams 180-1, 180-2 may be formed simultaneously in opposite directions when the beam control antenna element 115 is switched or fed to a first terminating reactance 150-1. The first terminating reactance 150-1 is specifically selected to cause the beam control antenna element 115 to act as a reflector in this mode. Since these two patterns 180-1, 180-2 cover approximately one-half of a hemisphere, they are likely to provide sufficient directivity performance for a useable antenna system.

In an optional configuration, if different antenna patterns are required, such as a "peanut" pattern 190 illustrated by the dashed line, then a multiple element switch 170 can be utilized to electrically connect a second terminating reactance 150-2 with the beam control antenna element 115. The multiple element switch 170 may be used to select among multiple reactances 150 to achieve a combination of the different patterns, resulting in one or more "peanut" patterns 190.

Thus, it is seen how the center beam control antenna element 115 can be connected either to a fixed reactance or switched into different reactances to generate different antenna patterns 180, 190 at minimal cost. In the preferred embodiment, at least three antenna elements, including the two active antenna elements 100 and single passive element 115, are disposed in a line such that they remain aligned in parallel. However, it should be understood that in certain embodiments they may be arranged at various angles with respect to one another.

Various other numbers and configurations of the antenna elements 100, switch 170, and passive beam control antenna element(s) 115 are possible. For example, multiple active antenna elements 100 (e.g., sixteen) may be used with four passive beam control antenna elements 115 interspersed among the active antenna elements 100, where each passive beam control antenna element 115 is electromagnetically coupled to a subset of the active antenna elements 100, where a subset may be as few as two or as many as sixteen, in the example embodiment.

Figure 3:
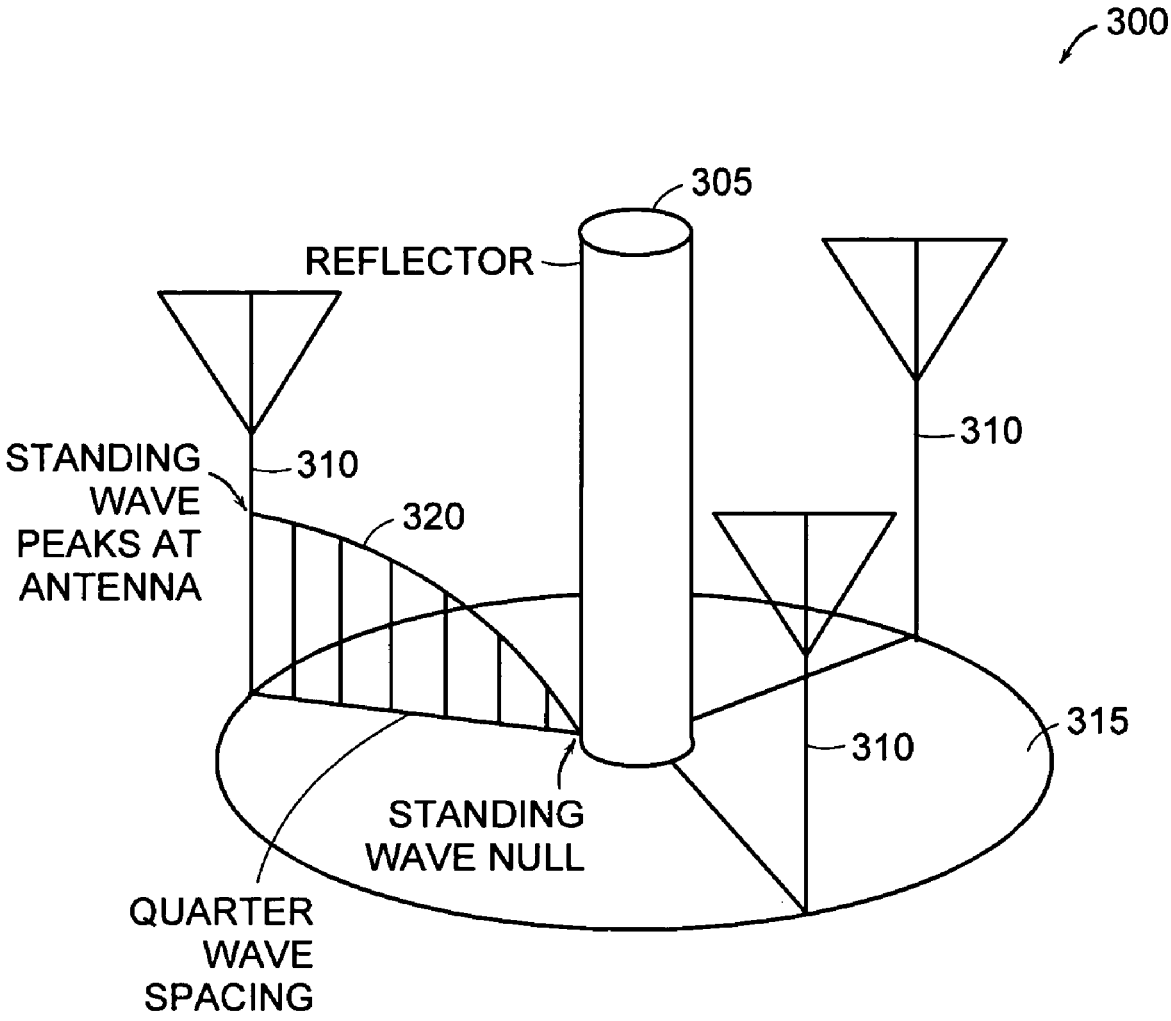
FIG. 3 is a diagram of another embodiment of the antenna assembly of FIG. 2.

Another embodiment of an antenna assembly according to the principles of the present invention is now discussed in reference to an antenna assembly 300 depicted in FIG. 3. The antenna assembly 300 uses a reflector or beam control antenna element 305, or multiple reflector antenna elements (not shown), and a phased array of active antenna elements 310. The antenna elements 305, 310 are, in this embodiment, mechanically disposed on a ground plane 315. The reflector antenna element 305 is used to create its own multi-path.

This multi-path is simple and is inside the active antenna elements 310. Because of the close proximity of the reflector antenna element 305 to the active antenna elements 310, its presence overrides other multi-paths and remove the nulls created by them. The new multi-path has a predictable property and is thus controllable. The phased array can be used to focus its beam on a signal, and the combination of reflector antenna element 305 and active antenna elements 310 removes fading and signal path misalignment, which creates "ghosts" often seen in TV receptions.

Figure 4A:
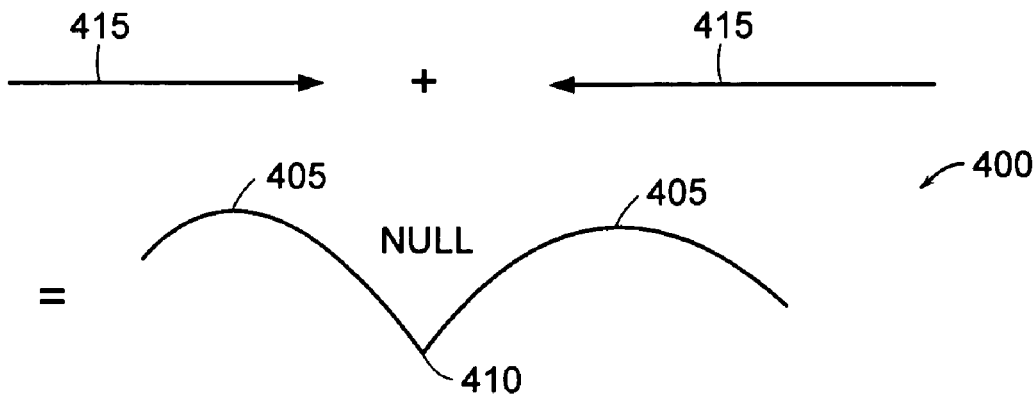
FIG. 4A is a generalized wave diagram related to the antenna assembly of FIG. 1.

In this embodiment, the reflector 305 is cylindrical and is situated in the center of the circular array 300 of active antenna elements 310. This distance between the active antenna elements 310 and the conducting surface of the reflector antenna elements 305 may be kept at a quarter wave length or less. The presence of the cylindrical reflector antenna element 305 prevents any wave from propagating through the array 300 of active antenna elements 310. It thus prevents the formation of standing waves created by the interfering effect of oppositely traveling waves 405, as indicated by the arrows 415 in FIG. 4A. The result is that the indoor nulls 410 are removed from the vicinity of the array elements 310. However, the beam control antenna element 305 creates its own standing waves, as depicted in FIG. 4B.

Figure 4B:
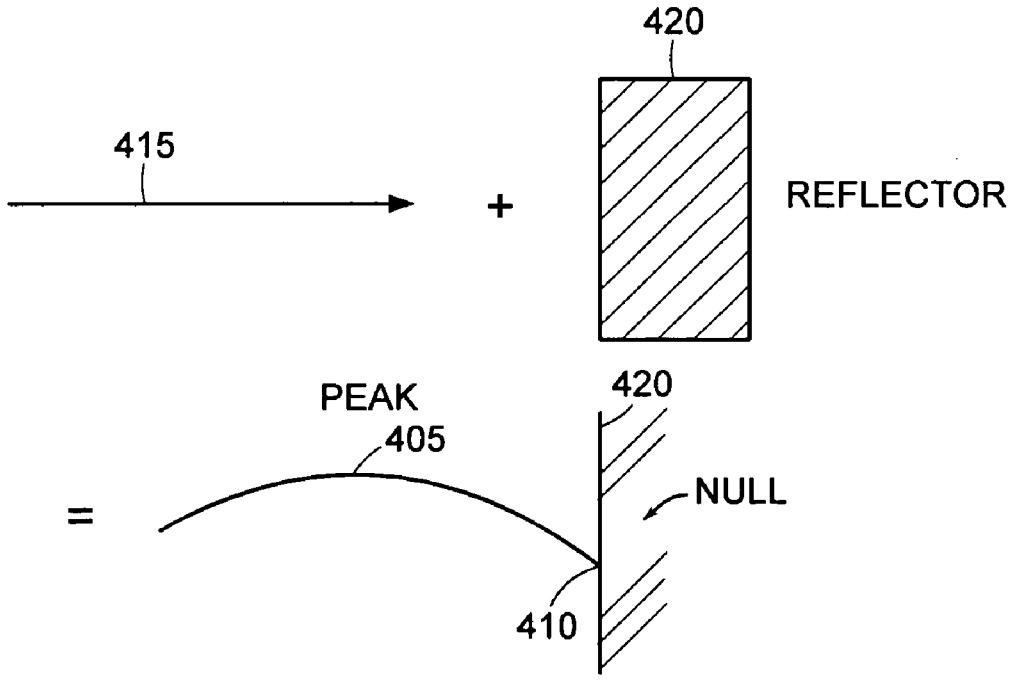
FIG. 4B is a wave diagram related to the antenna assemblies of FIGS. 2 and 3.

Referring now to FIG. 4B, the traveling wave 405 travels toward (i.e., arrow 415) a reflector 420. The reflector 420 forms a node 410 at the reflector 420 and standing wave 405 having a peak at the antenna elements 310 surrounding the reflector antenna element 305 as a result of the quarter wave spacing. So, with this arrangement, the nulls from the environment are removed, and, at the same time, this arrangement confines the signal peaks to the active antenna elements 310, which are ready to be phased into a beam that points to the strongest signal path, as determined by a processor (e.g., FIG. 2, DSP 130) coupled to the antenna array 300.

Figure 2:
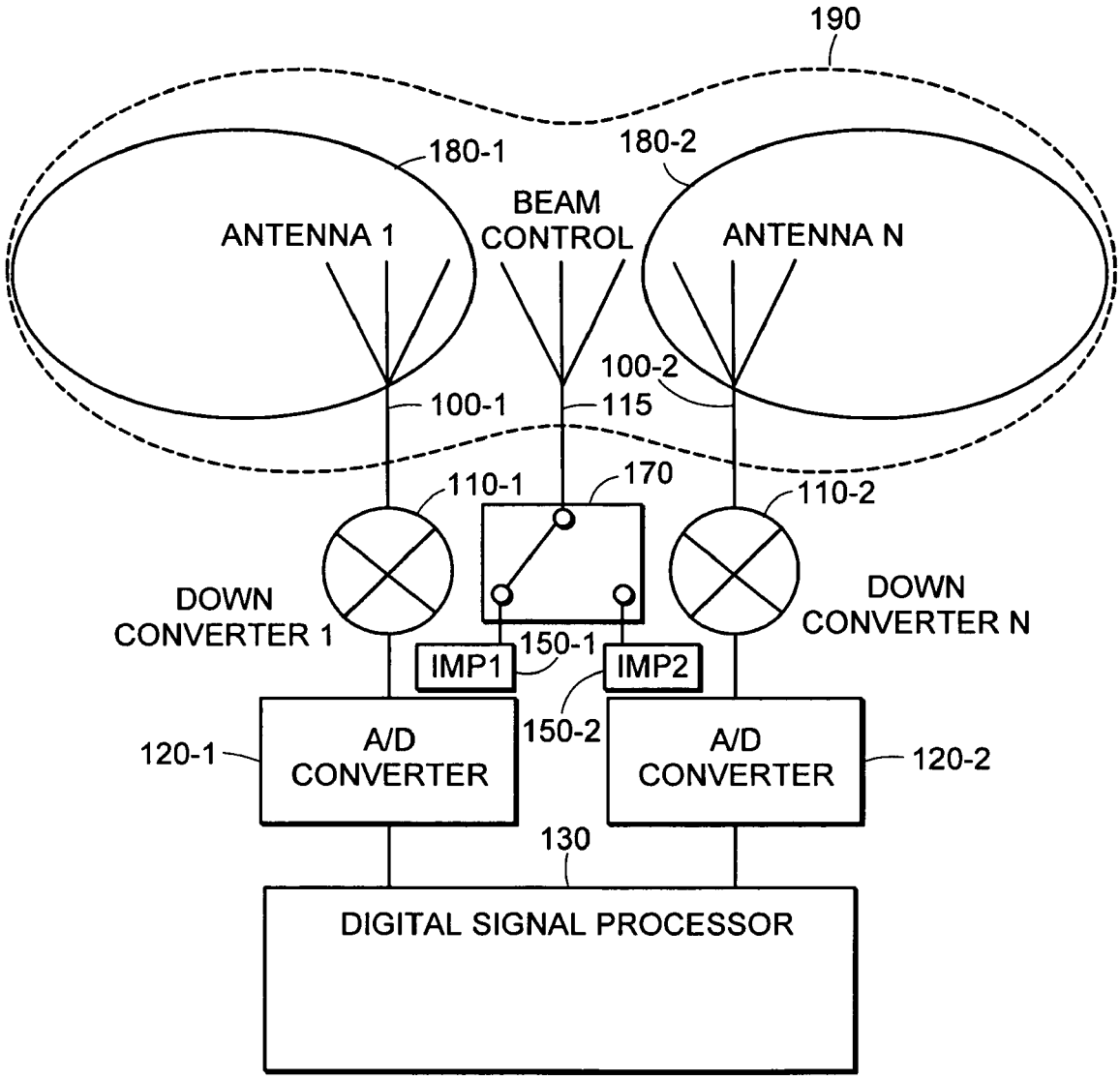
FIG. 2 is a schematic diagram of a beam former antenna system with an antenna assembly including two active antenna elements and one beam control antenna element according to the principles of the present invention.
Figure 5:
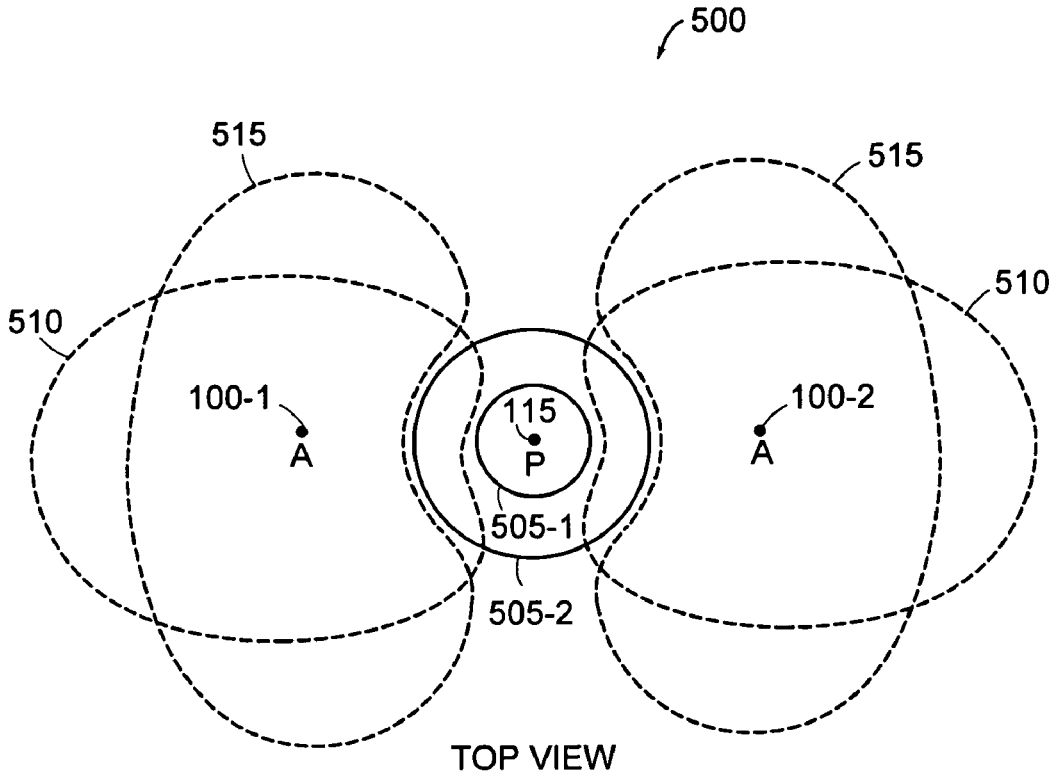
FIG. 5 is a top view of a beam pattern formed by another embodiment of the beam former system of FIG. 2.

FIG. 5 is a top view of example antenna beam patterns 500 formed by the linear antenna assembly of FIG. 2. In this embodiment, the beam control antenna element 115 is electrically connected to reactance components (e.g., FIG. 2, reactance components 150-1, 150-2) that creates respective effective reflective rings 505-1, 505-2. For example, the more inductance, the smaller the effective diameter of the ring 505 about the beam control antenna element 115.

Responsively, the antenna beam patterns 510, 515 produced by the antenna assembly 500, arranged in a linear array, are kidney shaped, as depicted by dash lines. As should be understood, the smaller the diameter of the reflection rings 505, the narrower the beam and, consequently, more gain, that is provided to the active antenna elements 100 in a perpendicular direction to the axis of the linear array. Note that the uncoupled antenna beam patterns 510, 515 do not form a "peanut" pattern as in FIG. 2, which is caused in part by the selection of the reactance components 150.

A secondary advantage of having this active/beam control/active antenna element arrangement is that the beam control antenna element 115 tends to isolate the two active antenna elements 100, so there is a potential to reduce the size of the array. It should be understood that the active antenna elements 100 may be spaced closer to one another or farther apart from one another, depending on the application. Further, the reflective antenna element 115 electromagnetically disposed between the active antenna elements 100 reduces losses due to mutual coupling. However, loading on the beam control antenna element 115 may make it directive instead of reflective, which increases coupling between the active antenna elements 100 and coupling losses due to same. So, there is a range of reactances that can be applied to the beam control antenna element 115 that is appropriate for certain applications.

Continuing to refer to FIG. 5, there are two basic modes of operation of the antenna array: (1) dual beam high gain (i.e., non-omnidirectional) mode, where the beam control antenna element 115 is reflective and (2) dual near-omni mode with low mutual coupling, where the center antenna element 115 is short enough but not too short so each active antenna element 100 sees the kidney-shaped beam 510, 515, as shown. The reason this is near-omni is because the antenna array is not circular, so it is not a true omnidirectional mode. As discussed above, changing the reactance electrically connected to the beam control antenna element 115 changes the mode of operation of the antenna array 500.

Examples of the reactances that may be applied to this center passive antenna element 115 are between about −500 ohms and 500 ohms. Also the height of the active antenna elements 100 may be about 1.2 inches, and the height of the passive antenna element 115 may be about 1.45 inches at an operating frequency of 2.4 GHz. It should be understood that these reactances and dimensions are merely exemplary and can be changed by proportionate or disproportionate scale factors.

Figure 6:
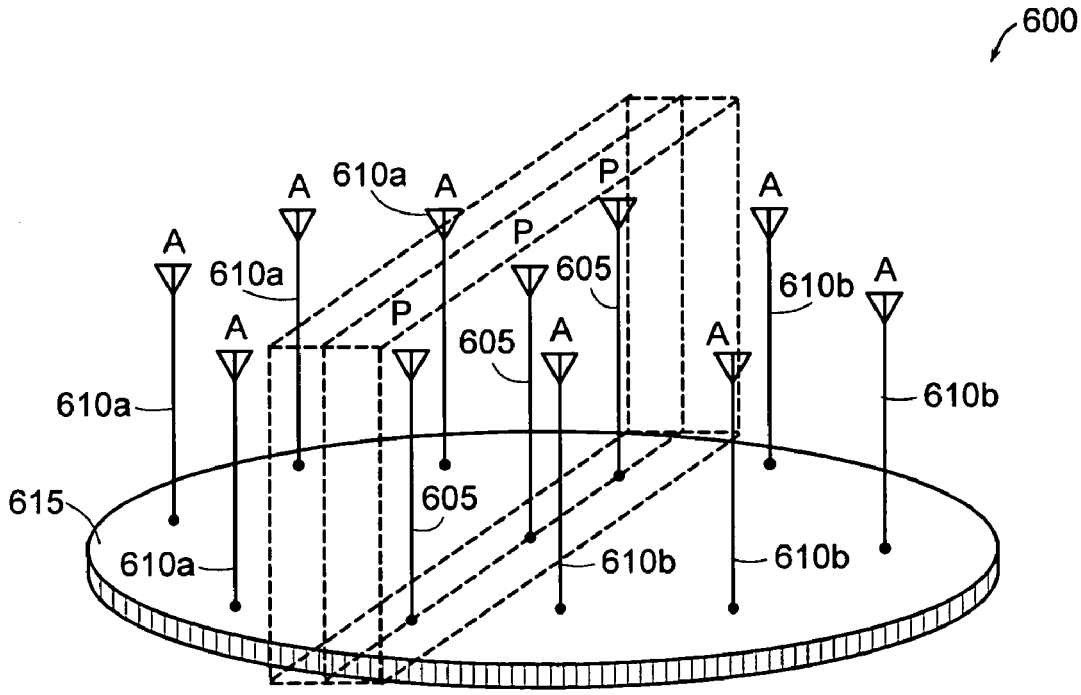
FIG. 6 is a diagram of another embodiment of the antenna assembly of FIG. 2.

FIG. 6 is a mechanical diagram of a circular antenna assembly 600. The circular antenna assembly 600 includes a subset of active antenna elements 610*a* separated by multiple beam control antenna elements 605 from another subset of active antenna elements 610*b*. The active antenna elements 610*a*, 610*b*, form a circular array. The beam control antenna elements 605 form a linear array.

The beam control antenna elements 605 are electrically connected to reactance elements (not shown). Each of the beam control antenna elements 605 may be selectably connected to respective reactance elements through switches, where the respective reactance elements may include sets of the same range of reactance or reactance values so as to increase the dimensions of a rectangular-shaped reflector 620, which surrounds the beam control antenna elements 605, by the same amount along the length of the beam control antenna elements 605. By changing the dimensions of the rectangular reflector 620, the shape of the beams produced by the active antenna elements 610*a*, 610*b* can be altered, and secondarily, the mutual coupling between the active antenna element 610*a*, 610*b* can be increased or decreased for a given application. It should be understood that more or fewer beam control antenna elements 605 can be employed for use in different applications depending on shapes of beam patterns or mutual coupling between active antenna element 610*a*, 610*b* desired. For example, instead of a linear array of beam control antenna elements 605, the array may be circular or rectangular in shape.

Figure 7:
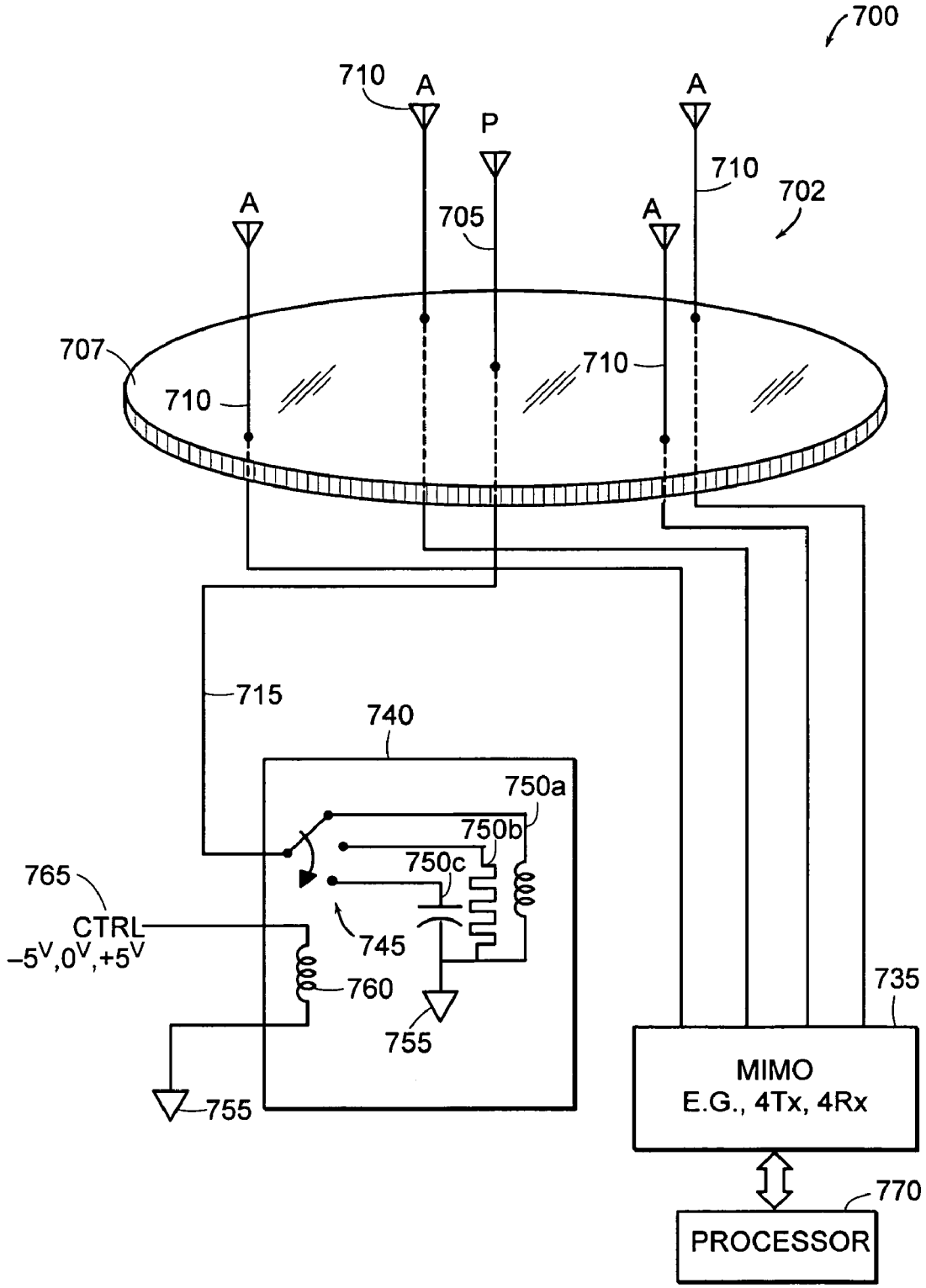
FIG. 7 is a schematic diagram of another embodiment of the beam former system of FIG. 2.

FIG. 7 is another embodiment of an antenna system 700 that includes an antenna assembly 702 with a beam control antenna element 705 and multiple active antenna elements 710 disposed on a reflective surface 707 in a circular arrangement and electromagnetically coupled to at least one beam control antenna element 705. As discussed above, the beam control antenna element 705 is electrically connected to an reactance or reactance, such as an inductor 750*a*, delay line 750*b*, or capacitor 750*c*, which are electrically connected to a ground. Other embodiments may include a lumped reactance, such as a (i) capacitor and inductor or (ii) variable reactance element that is set through the use of digital control lines. The reactive elements 750, in this embodiment, are connected to feed line 715 via a single-pole, multiple-throw switch 745. The feed line 715 connects the beam control antenna element 705 to the switch 745.

A control line 765 is connected to the ground 755 or a separate signal return through a coil 760 that is magnetically connected to the switch 745. Activation of the coil 760 causes the switch to connect the beam control antenna element 705 to ground 755 through a selected reactance element 750. In this embodiment, the switch 745 is shown as a mechanical switch. In other embodiments, the switch 745 may be a solid state switch or other type of switch with a different form of control input, such as optical control. The switch 745 and reactance elements 750 may be provided in a various forms, such as hybrid circuit 740, Application Specific Integrated Circuit (ASIC) 740, or discrete elements on a circuit board.

A processor 770 may sequence outputs from the antenna array 702 to determine a direction that maximizes a signal-to-noise ratio (SNR), for example, or maximizes another beam direction related metric. In this way, the antenna assembly 702 may provide more signal capacity than without the processor 770. With the MIMO 735, the antenna system 700 can look at all sectors at all times and add up the result, which is a form of a diversity antenna with more than two antenna elements. The use of the MIMO 735, therefore, provides much increase in information throughput. For example, instead of only receiving a signal through the antenna beam in a primary direction, the MIMO 735 can simultaneously transmit or receive a primary signal and multi-path signal. Without being able to look at all sectors at all times, the added signal strength from the multi-path direction is lost.

Figure 8A:
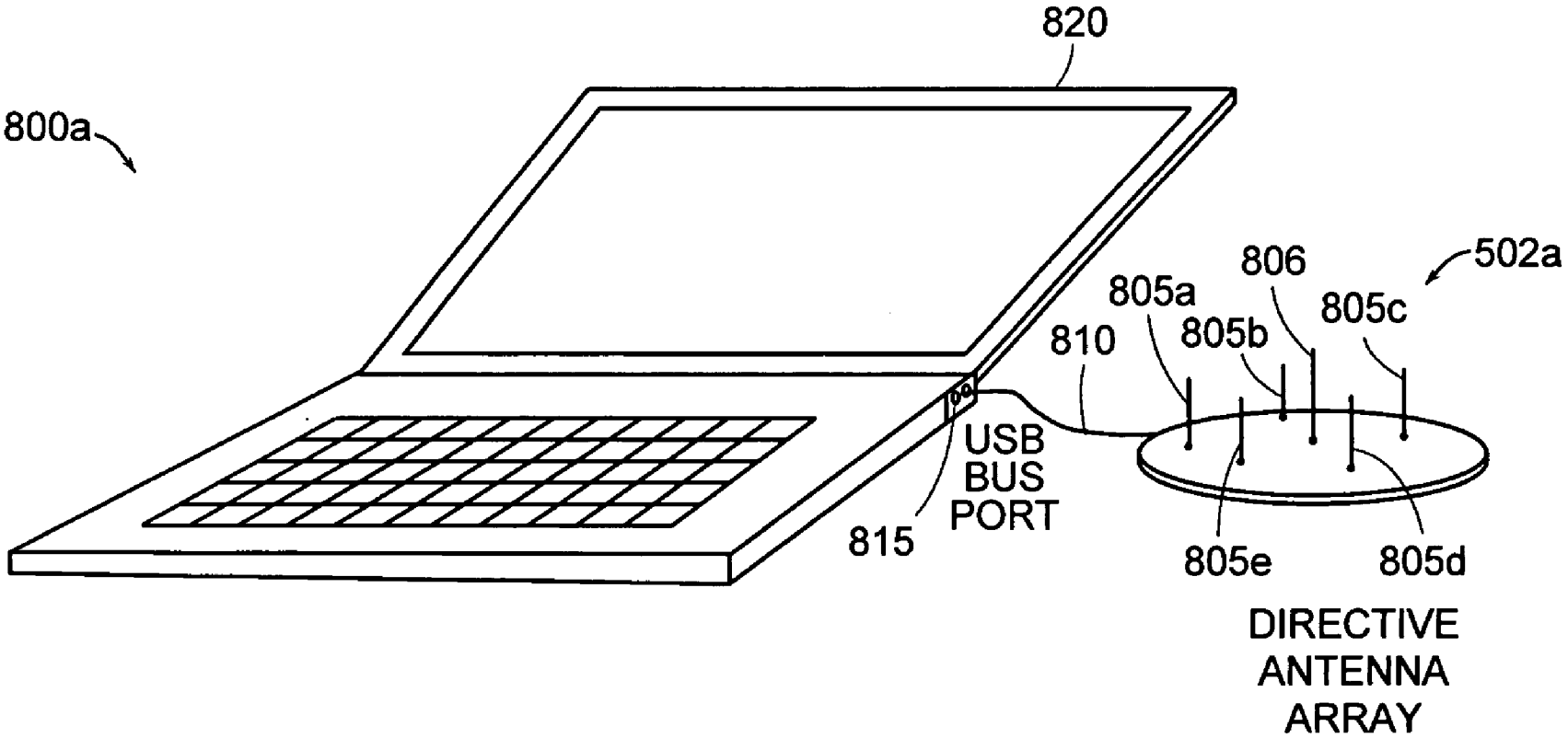
FIG. 8A is a diagram of a user station in an 802.11 network using the beam former system of FIG. 7 with external antenna assembly.

FIG. 8A is a diagram of an example use in which the directive antenna array 502*a* may be employed. In this example, a station 800*a* in an 802.11 network, for example, or a subscriber unit in a CDMA network, for example, may include a portable digital system 820 such as a personal computer, personal digital assist (PDA), or cellular telephone that uses a directive antenna assembly 502. The directive antenna assembly 502 may include multiple active antenna elements 805 and a beam control antenna element 806 electromagnetically coupled to the active antenna elements 805. The directive antenna assembly 502*a* may be connected to the portable digital system 820 via a Universal System Bus (USB) port 815.

Figure 8B:
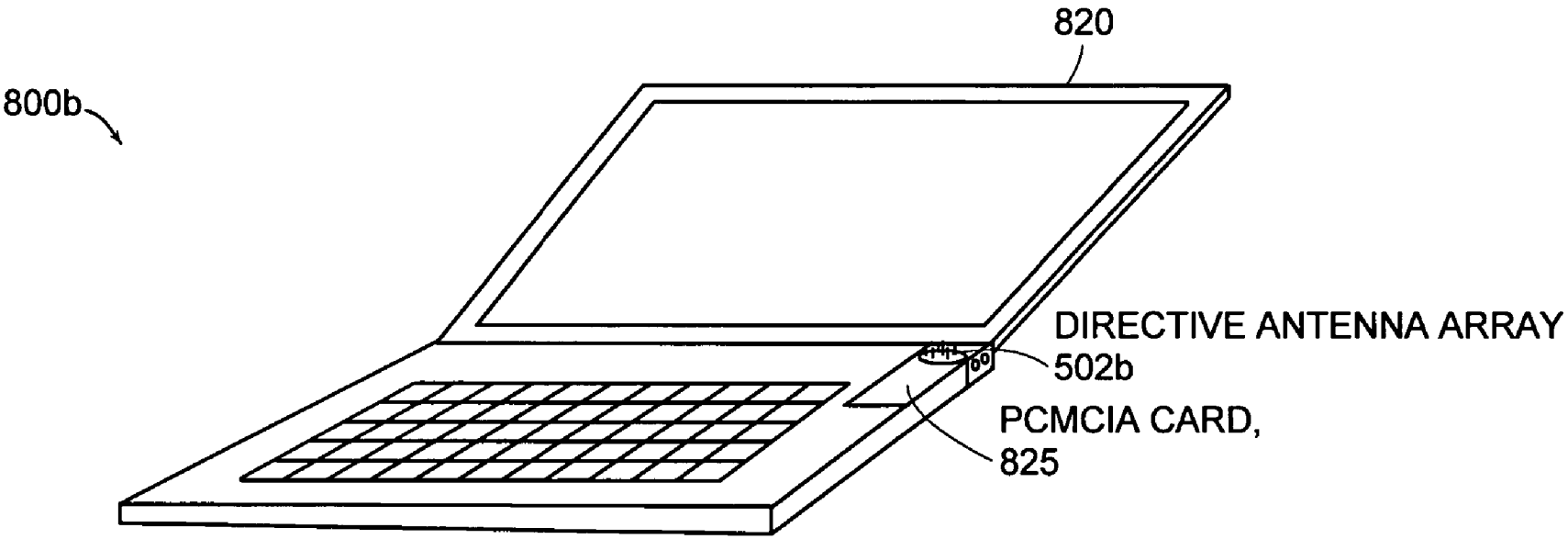
FIG. 8B is a diagram the user station of FIG. 8A using an internal antenna assembly.

In another embodiment, a station 800*b* of FIG. 8B includes a PCMCIA card 825 that includes a directive antenna assembly 502*b* on the card 825. The PCMCIA card 825 is installed in the portable digital device 820.

It should be understood that the antenna assembly 502 in either implementation of FIG. 8A or 8B may be deployed in an Access Point (AP) in an 802.11 network or base station in a wireless cellular network. Further, the principles of the present invention may also be employed for use in other types of networks, such as a Bluetooth network and the like.

Figure 9:
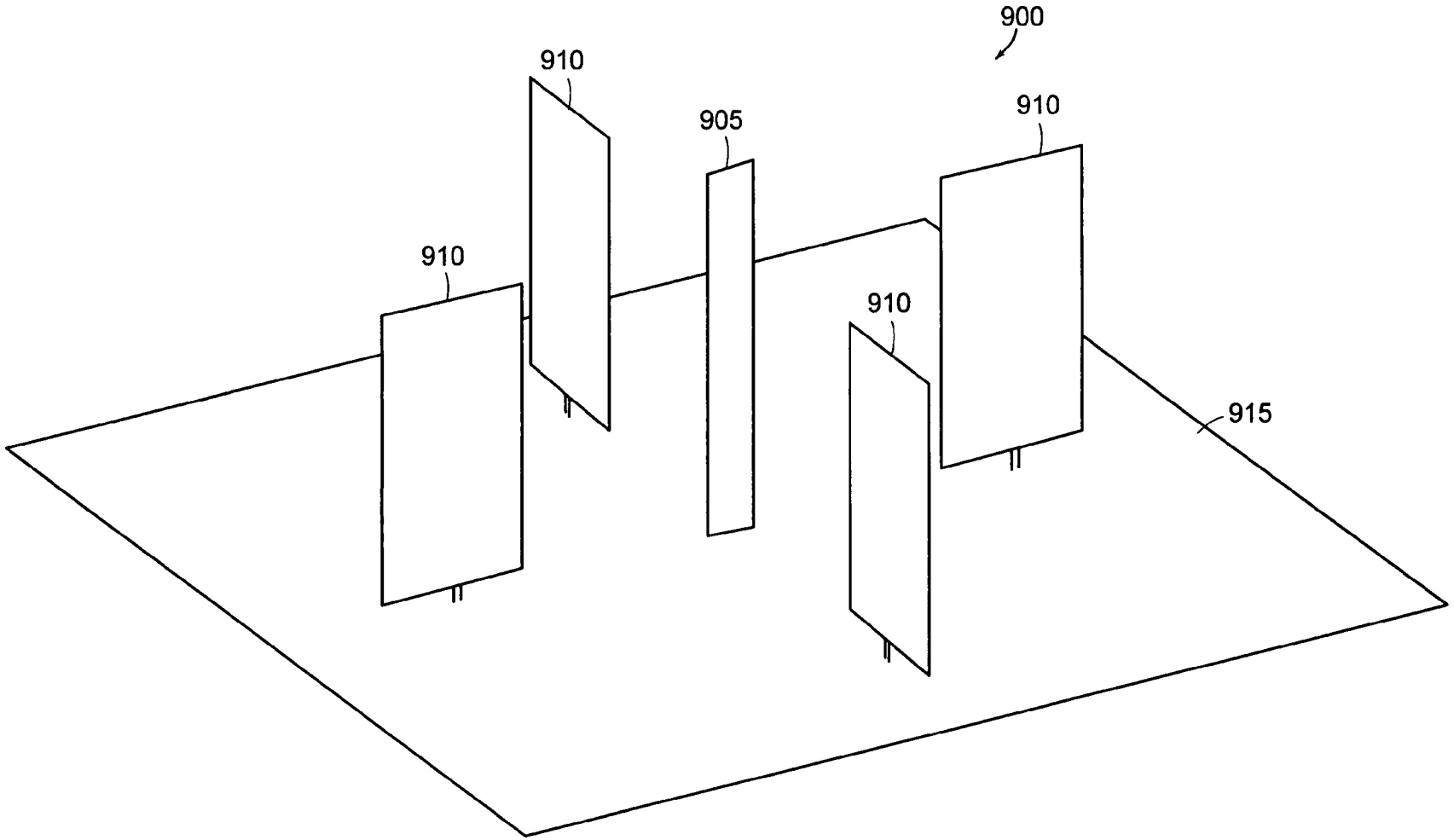
FIG. 9 is a diagram of another embodiment of the antenna assembly of FIG. 2.

FIGS. 9-11 represent an antenna assembly 900 and associated simulated antenna beam patterns produced thereby.

Referring first to FIG. 9, the antenna assembly 900 includes four active antenna elements 910 deployed along a perimeter of a circle and a central beam control antenna element 905. The antenna elements 905, 910 are mechanically connected to a ground plane 915.

In this embodiment, the active antenna elements 910 have dimensions 0.25" to 3.0" W×0.5" to 3.0" H, which are optimized for the 2.4 GHz ISM band (802.11b). The beam control antenna element 905 has dimensions 0.2" W×1.45" H. The height of the beam control antenna element 905 is longer in this embodiment to provide more reflectance and is not as wide to reduce directional characteristics.

Figure 10A:
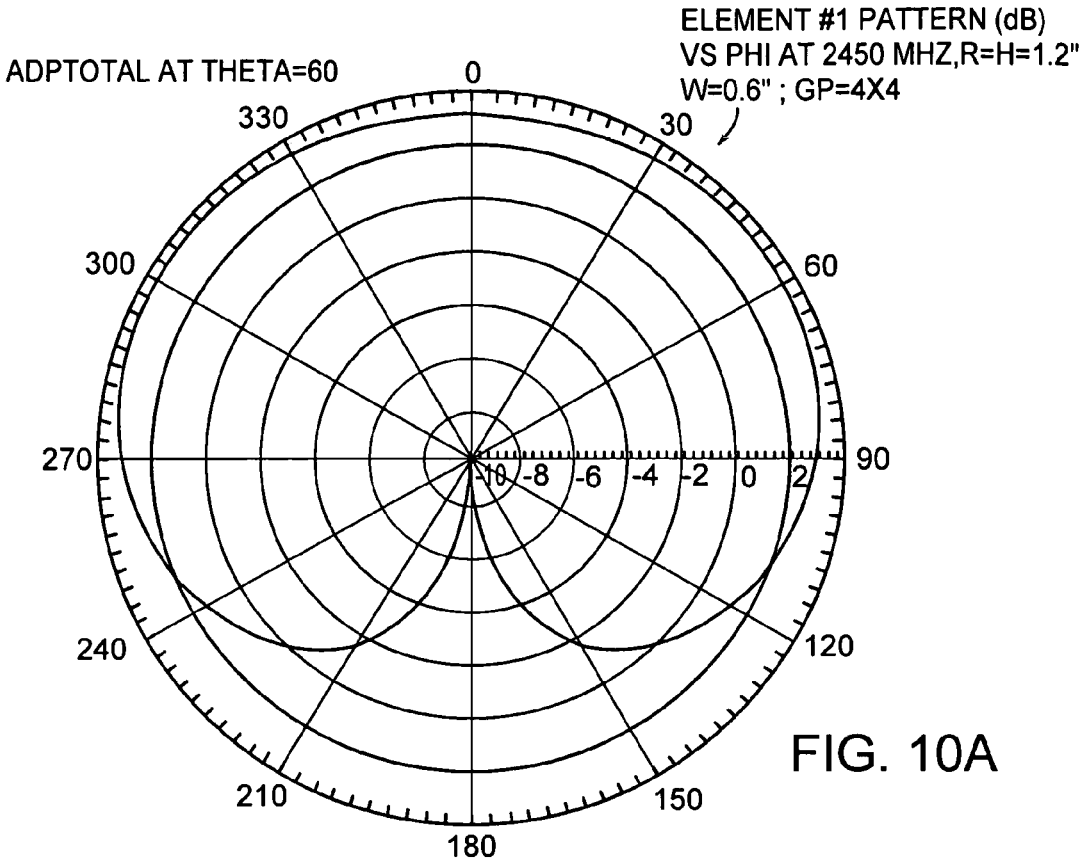
FIGS. 10A-10D are antenna directivity patterns for the antenna assembly of FIG. 9.
Figure 10B:
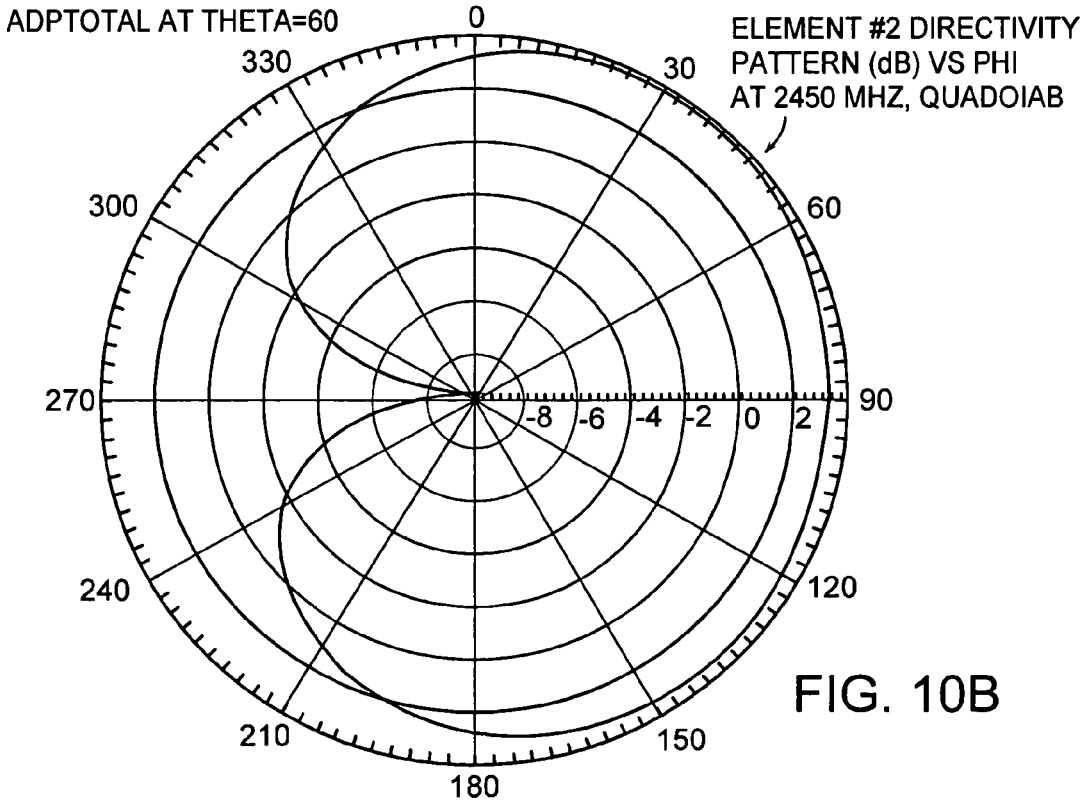
Figure 10C:
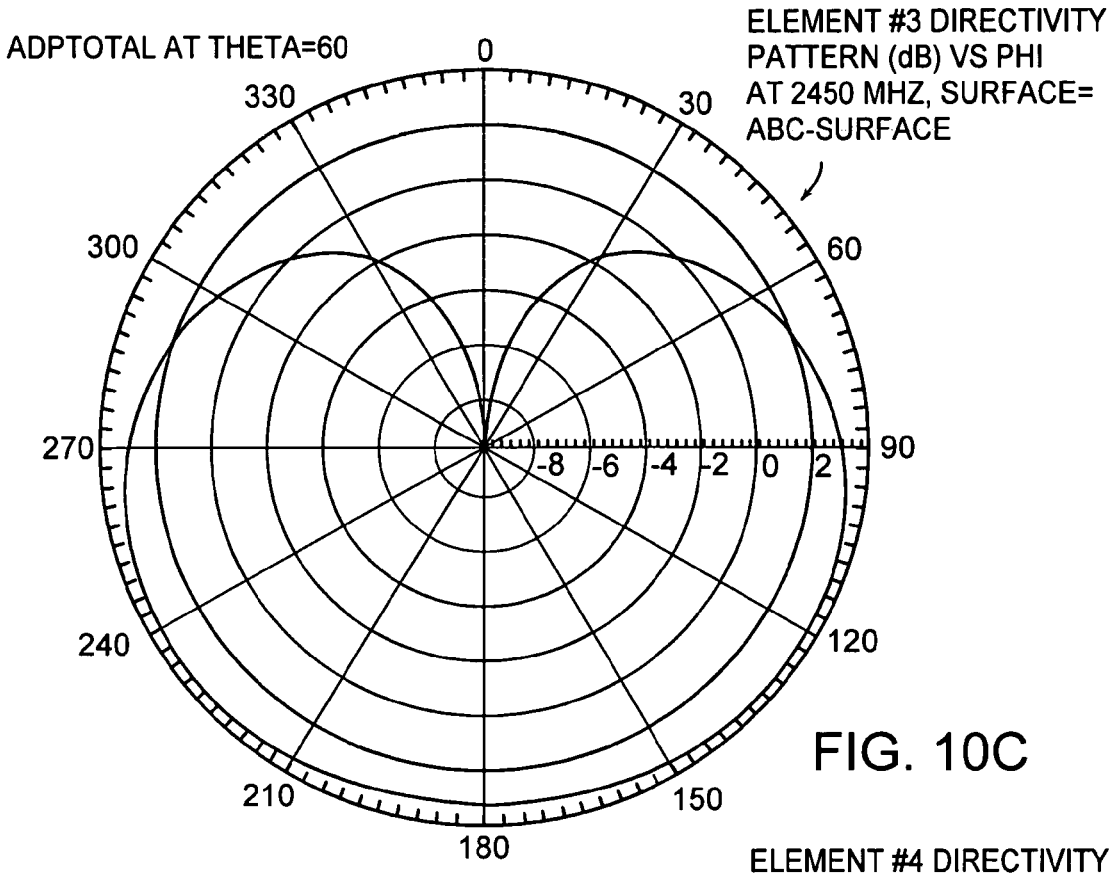
Figure 10D:
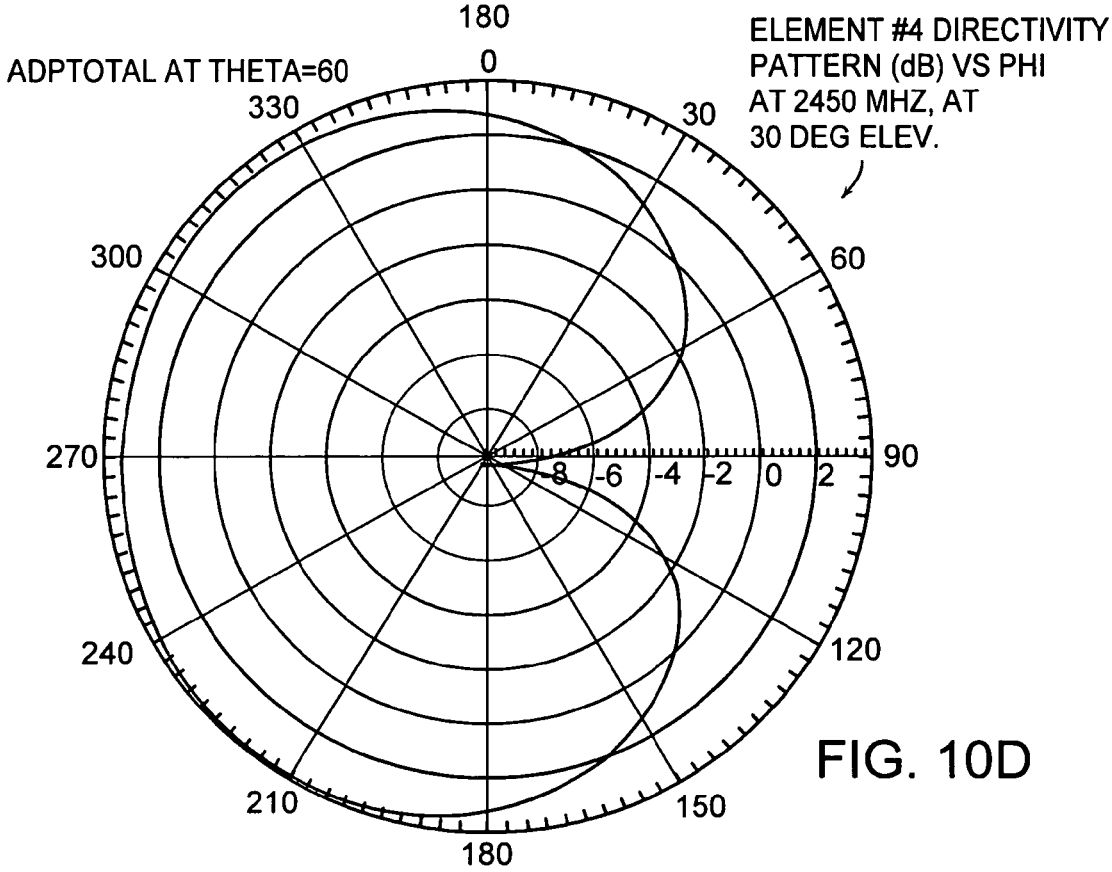
Figure 10E:
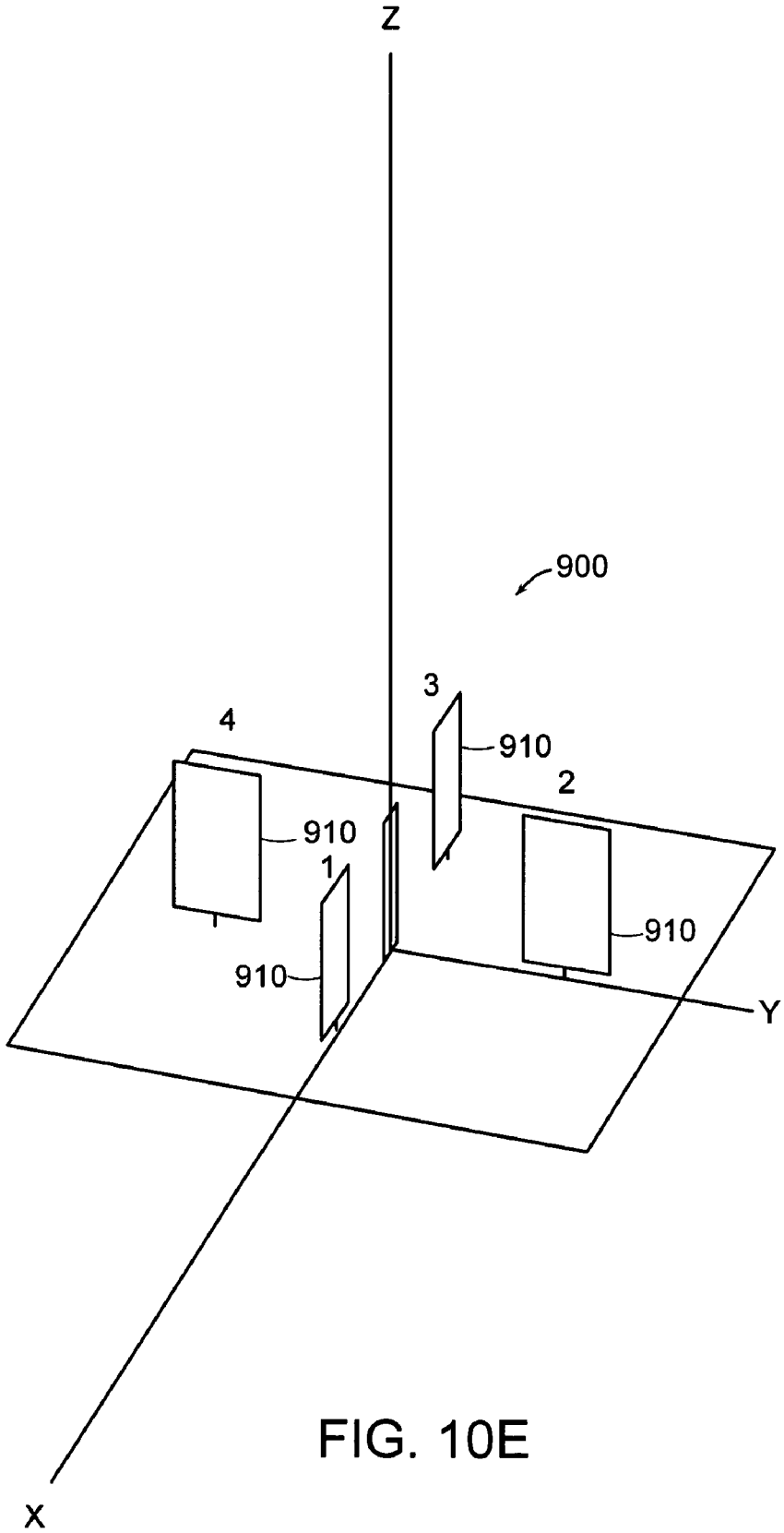
FIG. 10E is a diagram of the antenna assembly of FIG. 9 represented on x, y, and z coordinate axes.

FIGS. 10A-10D are simulated beam patterns for the antenna assembly 900 of FIG. 9. The antenna assembly 900 has been redrawn with x, y, and z axes as shown in FIG. 10E. The simulated beam patterns of FIGS. 10A-10D are for individual active antenna elements 910. The simulation is for 802.11b with a carrier frequency of 2.45 GHz. The beam patterns are shown for azimuth (x-y plane) at Phi=0 degs to 360 degs and elevation=30 degrees, or theta=60 degrees. The simulated beam pattern of FIG. 10A corresponds to the active antenna element 910 that lies along the +x axis. The null in the 180 degree direction represents the interaction between the active antenna element 910 and the beam control antenna element 905. Similarly, the simulated beam pattern of FIG. 10B corresponds to the active antenna element that lies along the +y axis; the simulated beam pattern of FIG. 10C corresponds to the active antenna element 910 that lies along the −x axis; and the simulated beam pattern of FIG. 10D corresponds to the active antenna element 910 that lies along the −y axis. The nulls in simulated beam patterns of FIGS. 10B-10D correspond to the respective active antenna elements 910 and beam control antenna element 905 interactions.

Figure 11A:
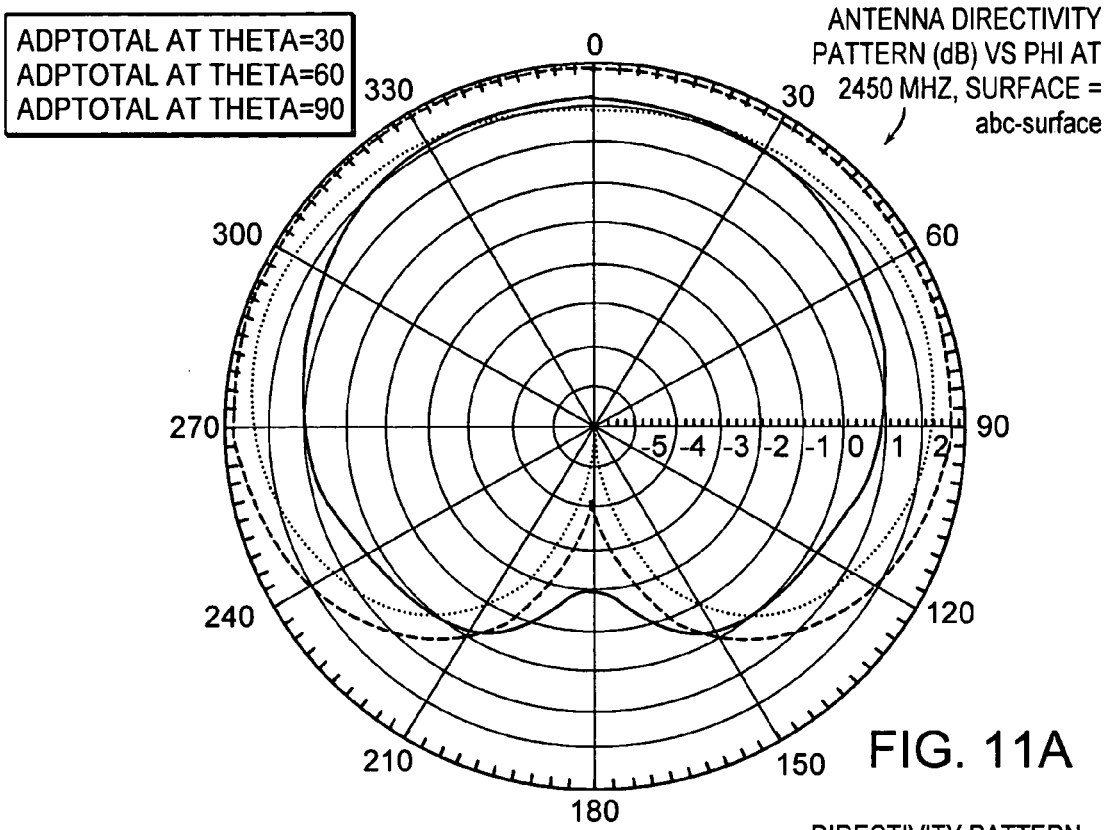
FIGS. 11A-11C are antenna directivity patterns for the antenna assembly of FIG. 9.
Figure 11B:
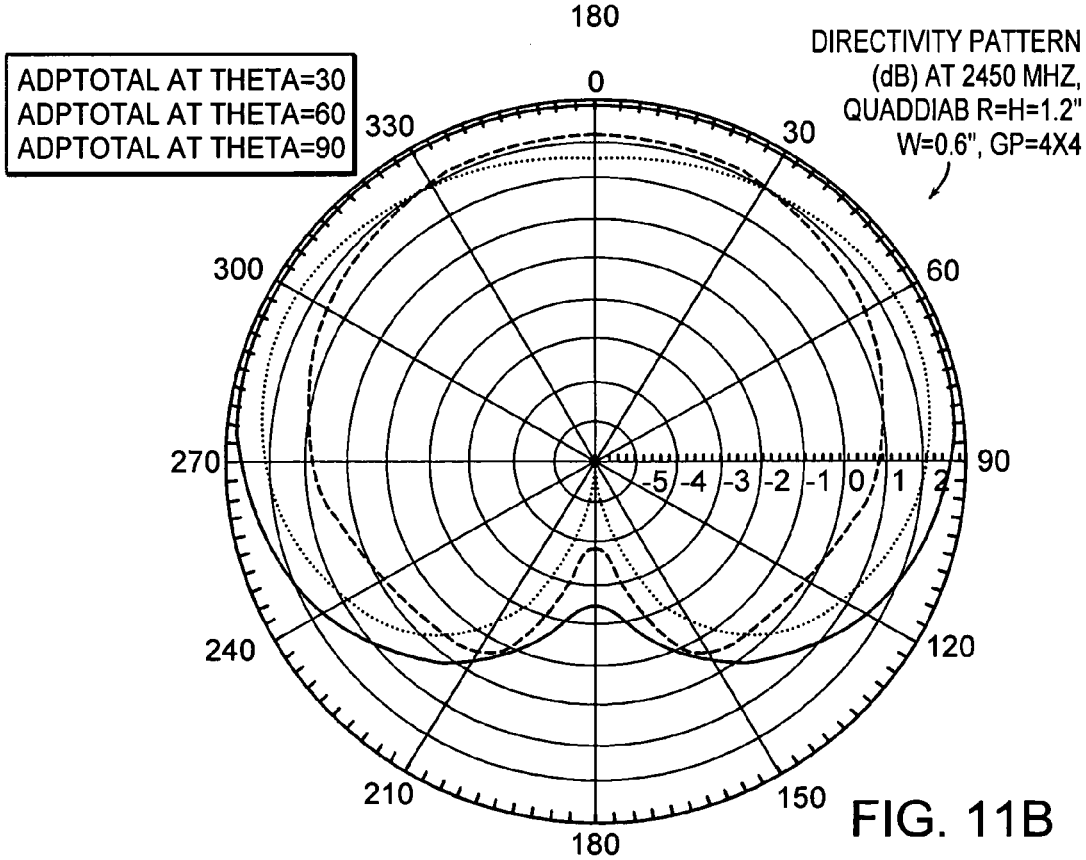
Figure 11C:
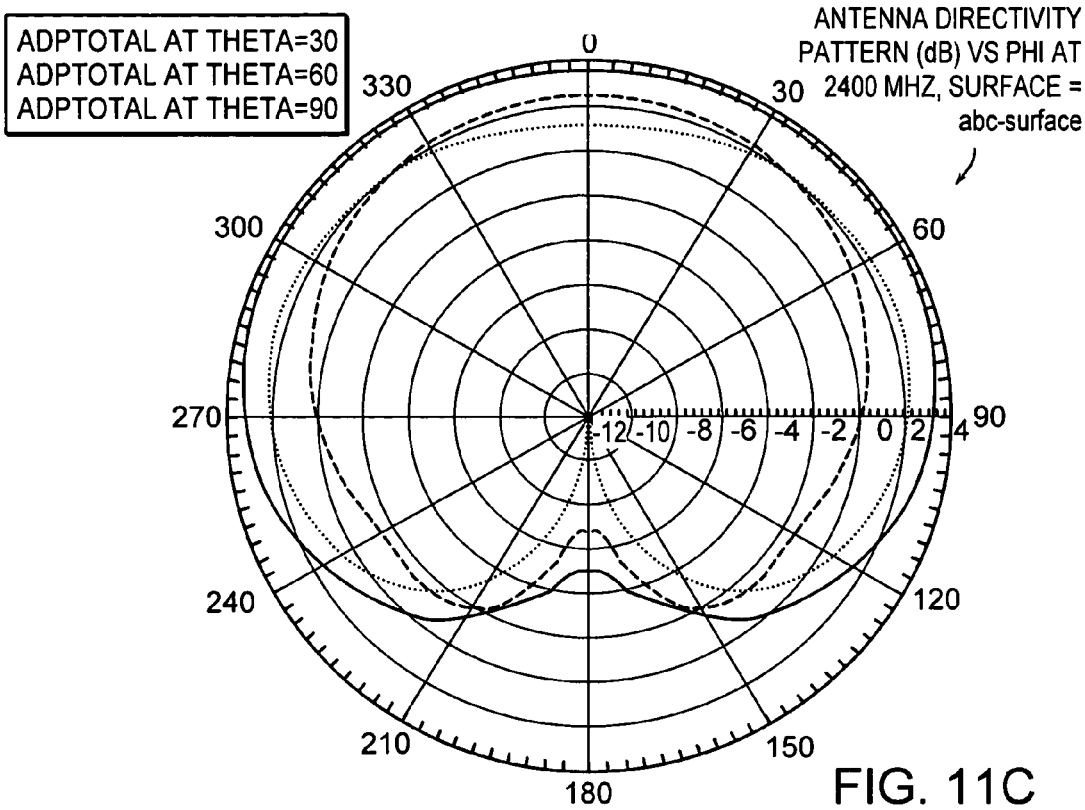

Referring now to FIGS. 11A-11C, these simulated antenna directivity (i.e., beam) patterns correspond to the antenna beams produced by the active antenna 910 in the antenna assembly 900 that lies along the +x axis. Each of FIGS. 11A-11C have three antenna directivity curves for theta=30, 60, and 90 degrees, where the angles are degrees from zenith (i.e, zero degrees points along the +z axis. The simulations of FIGS. 11A-11C are for 2.50, 2.45, and 2.40 GHz, respectively.

Figure 11D:
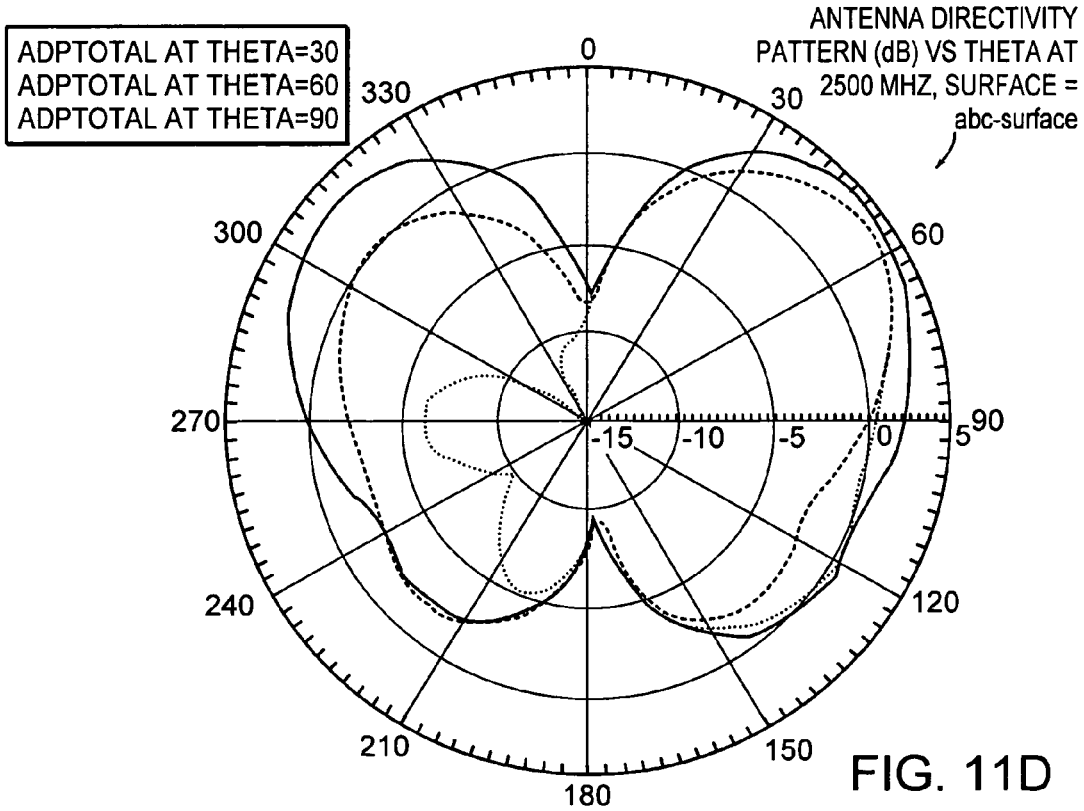
FIGS. 11D-11F are antenna directivity patterns for the antenna assembly of FIG. 9.
Figure 11E:
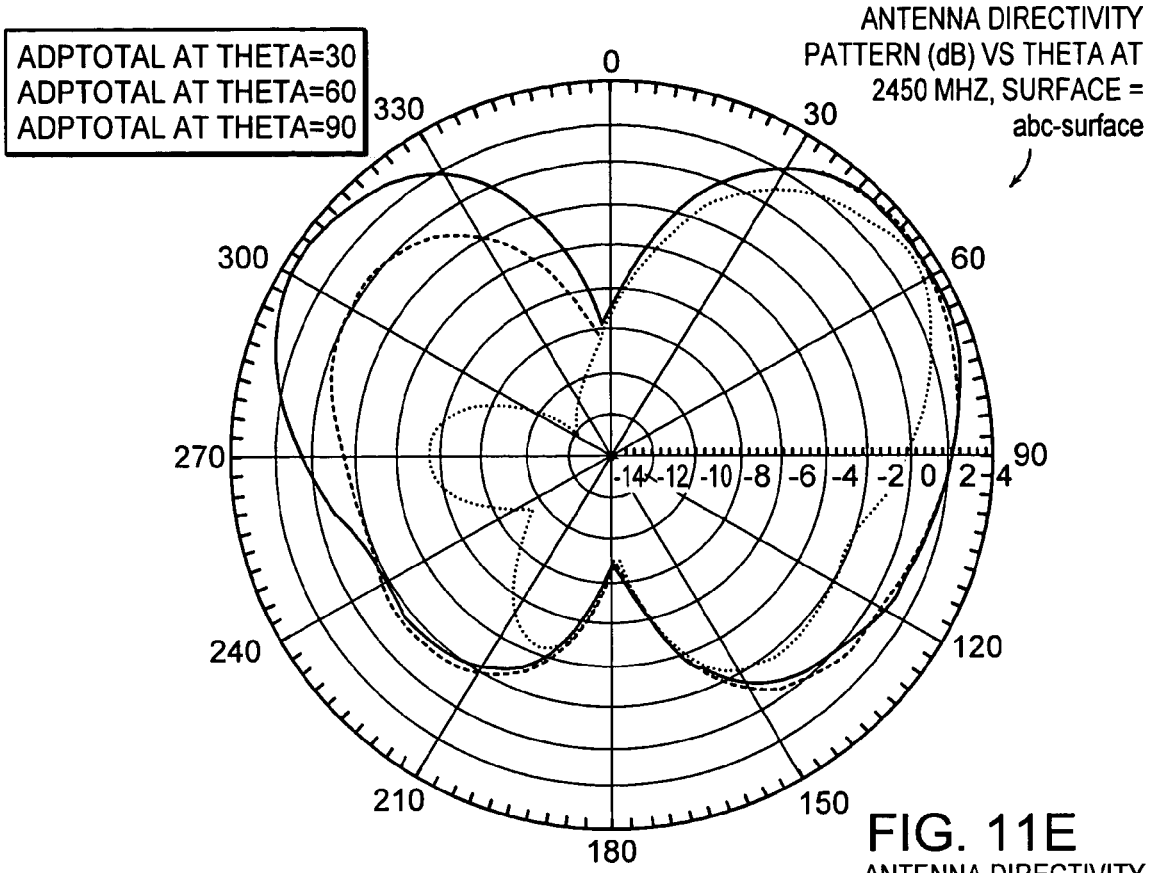
Figure 11F:
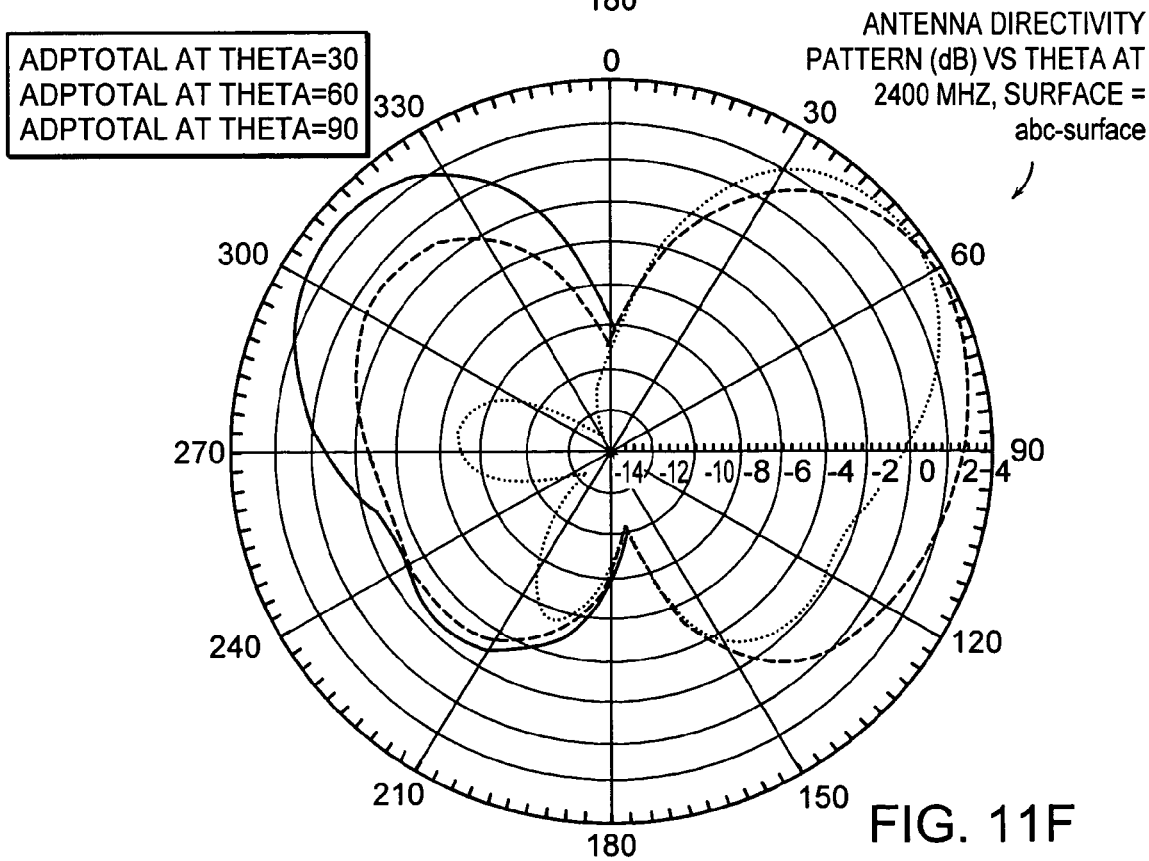

FIGS. 11D-11F are simulated antenna directivity patterns for the elevation direction corresponding to the simulated antenna directivity (i.e., beam) patterns of FIGS. 11A-11C. The three curves correspond to Phi=0, 45, and 90 degrees, where the angles are degrees from zenith.

Figure 12A:
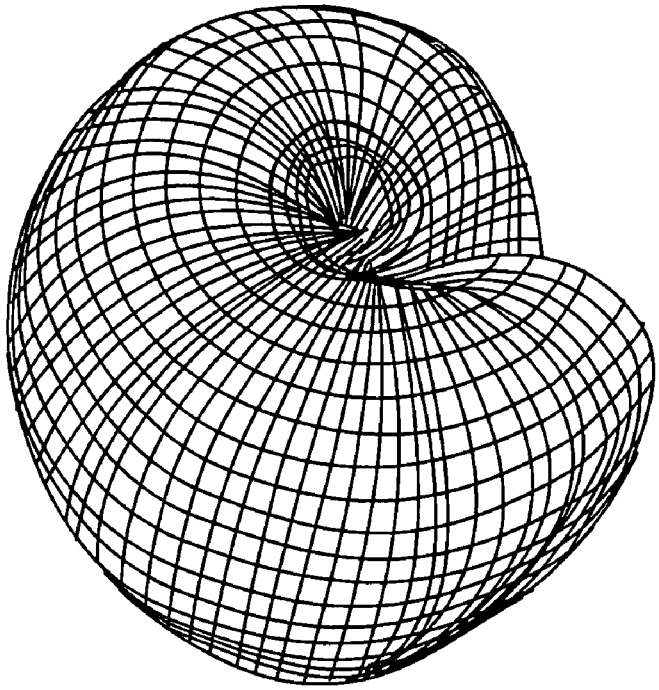
FIGS. 12A-12C are three-dimensional antenna directivity patterns for the antenna assembly of FIG. 9.
Figure 12B:
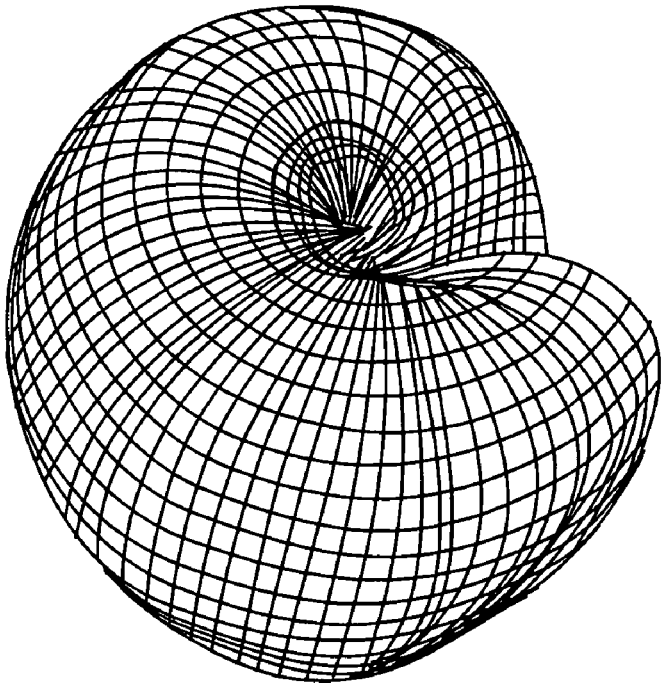
Figure 12C:
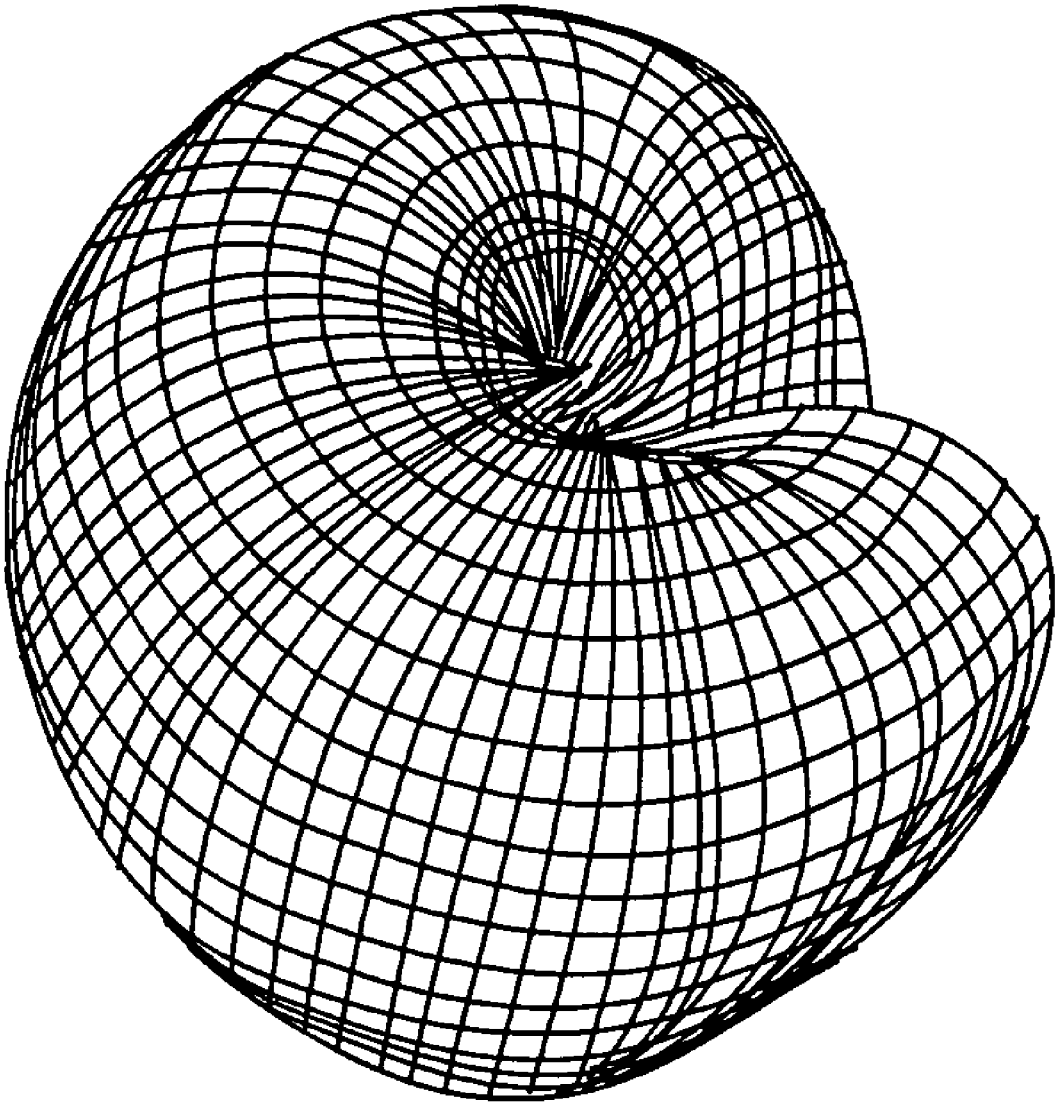

FIGS. 12A-12C are three-dimensional plots corresponding to the cumulative plots of FIGS. 11A-11F.

While this invention has been particularly shown and described with references to preferred embodiments thereof, it will be understood by those skilled in the art that various changes in form and details may be made therein without departing from the scope of the invention encompassed by the appended claims.

What is claimed is:

1. An apparatus, comprising:

multiple active antenna elements;

at least one beam control antenna element electromagnetically coupled to at least two of the active antenna elements and electromagnetically disposed between the at least two of the active antenna elements; and at least one device operatively coupled to said at least one beam control antenna element to affect at least one antenna beam pattern formed by the apparatus;

said at least one device providing at least two modes of operation for the apparatus and said at least two modes including a non-omnidirectional mode and a substantially omni-directional mode.

2. The apparatus according to claim 1 wherein said at least one device is operatively coupled to said at least one beam control antenna element to affect the electromagnetic coupling between the at least two of the active antenna elements.

3. The apparatus according to claim 1 wherein said at least two modes reduces electromagnetic coupling by respective amounts between the at least two active antenna elements.

4. The apparatus according to claim 1 further including a processor coupled to the active antenna elements and said at least one device, the logic used to select state settings for said at least one device based on a signal received by the active antenna elements.

5. The apparatus according to claim 1 wherein the at least one beam control antenna element is directly attached to ground.

6. The apparatus according to claim 1 wherein the at least one beam control antenna element is coupled to ground through a reactance.

7. The apparatus according to claim 6 wherein said at least one device includes a switch.

8. The apparatus according to claim 7 wherein the switch includes a number of switch states and a like number of reactance elements coupled to the switch.

9. The apparatus according to claim 1 wherein the spacing between the active antenna elements is about half of the wavelength of a carrier signal transmitted or received by the active antenna elements.

10. The apparatus according to claim 1 wherein the spacing between the electromagnetically coupled active antenna elements and at least one beam control antenna element is about one-quarter of the wavelength of a carrier signal transmitted or received by the active antenna elements.

11. The apparatus according to claim 1 wherein the active antenna elements are arranged in a one-dimensional array or curvilinear array.

12. The apparatus according to claim 1 wherein the active antenna elements are arranged in a 2-dimensional array.

13. The apparatus according to claim 1 wherein the at least two beam control antenna elements are arranged in a 1-dimensional array.

14. The apparatus according to claim 1 wherein the at least two beam control antenna elements are arranged in a 2-dimensional array.

15. The apparatus according to claim 1 wherein at least one of the at least two beam control antenna elements are positionally offset from an imaginary line spanning between the at least two active antenna elements with which the at least two beam control antenna elements are electromagnetically coupled.

16. The apparatus according to claim 1 wherein the at least two beam control antenna elements are spaced father apart from each other than they are from respective active antenna elements with which they are electromagnetically coupled.

17. The apparatus according to claim 16 wherein the at least two beam control antenna elements are positioned substantially in-line with the respective active antenna elements with which they are electromagnetically coupled.

18. The apparatus according to claim 1 used in a base station, handset, wireless access point, or client or station device.

19. The apparatus according to claim 1 used in a cellular network, Wireless Local Area Networks (WLAN), Time Division Multiple Access (TDMA) system, Code Division Multiple Access (CDMA) system, or GSM system.

20. An apparatus, comprising:

multiple active antenna elements; and at least one beam control antenna element electromagnetically coupled to at least two of the active antenna elements and electromagnetically disposed between the at least two of the active antenna elements, the two active antenna elements being arranged in a two dimensional array having a substantially circular pattern.

21. An apparatus, comprising:

multiple active antenna elements;

at least one beam control antenna element electromagnetically coupled to at least two of the active antenna elements and electromagnetically disposed between the at least two of the active antenna elements, and a multiple-input multiple-output (MIMO) processing unit having multiple transmitters or receivers adapted to operate with the multiple active antenna elements.

* * * * *

UNITED STATES PATENT AND TRADEMARK OFFICE

CERTIFICATE OF CORRECTION

PATENT NO. : 7,253,783 B2
APPLICATION NO. : 11/101914
DATED : August 7, 2007
INVENTOR(S) : Chiang et al.

It is certified that error appears in the above-identified patent and that said Letters Patent is hereby corrected as shown below:

At column 2, line 26, before the word “pattern”, delete “radiator” and insert therefor --radiation--.

At column 3, line 32, after the word “diagram”, insert “of”.

At column 6, line 67, before the words “or reactance”, delete “an reactance” and insert therefor --an inductance--.

At column 7, line 19, before the word “various”, delete “a”.

Signed and Sealed this

Thirteenth Day of May, 2008

JON W. DUDAS
*Director of the United States Patent and Trademark Office*